United States Patent [19]

Simpson et al.

[11] Patent Number: 4,770,725

[45] Date of Patent: Sep. 13, 1988

[54] NICKEL/TITANIUM/NIOBIUM SHAPE MEMORY ALLOY & ARTICLE

[75] Inventors: John A. Simpson, Mountain View; Keith Melton, Cupertino; Tom Duerig, Fremont, all of Calif.

[73] Assignee: Raychem Corporation, Menlo Park, Calif.

[21] Appl. No.: 59,138

[22] Filed: Jun. 5, 1987

Related U.S. Application Data

[63] Continuation of Ser. No. 809,837, Dec. 13, 1985, abandoned, which is a continuation of Ser. No. 668,777, Mar. 6, 1984, abandoned.

[51] Int. Cl.[4] ..... C22F 1/00

[52] U.S. Cl. ..... 148/402; 148/421; 148/422; 148/426; 148/442

[58] Field of Search ..... 148/402, 421, 422, 426, 148/442; 420/425, 441, 417, 580

[56] References Cited

U.S. PATENT DOCUMENTS

| | | | |
|---|---|---|---|
| 3,662,455 | 5/1972 | Anderson | 420/580 |
| 3,740,839 | 6/1973 | Otte et al. | 29/628 |
| 3,753,700 | 8/1973 | Harrison et al. | 148/402 |
| 4,019,899 | 4/1977 | Negishi et al. | 420/451 |
| 4,035,007 | 7/1977 | Harrison et al. | 420/580 |
| 4,036,669 | 7/1977 | Brook et al. | 148/11.5 C |
| 4,067,752 | 1/1978 | Brook et al. | 148/11.5 R |
| 4,095,999 | 6/1978 | Brook et al. | 148/11.5 R |
| 4,198,081 | 4/1980 | Harrison et al. | 420/580 |
| 4,205,293 | 5/1980 | Melton et al. | 337/140 |

FOREIGN PATENT DOCUMENTS

| | | | |
|---|---|---|---|
| 2129164 | 12/1971 | Fed. Rep. of Germany | 420/451 |
| 58-157934 | 9/1983 | Japan | 420/451 |
| 59-28548 | 2/1984 | Japan | 420/417 |

OTHER PUBLICATIONS

U.S. patent application, "Nickel/Titanium/Vanadium Shape Memory Alloy", by Mary P. Quin, filed Oct. 14, 1983, U.S. Ser. No. 541,844.

U.S. patent application, "Nickel/Titanium/Copper Shape Memory Alloy", by John D. Harrison, filed Sep. 29, 1983, U.S. Ser. No. 537,316.

Ternary Intermetallic Compounds in the System Ni--Ti-Nb, by L. I. Pryakhina et al., in Poroshkovaya Metallurgiya, No. 8(44), pp. 61-69, Aug., 1966 (Translation).

Effects of Alloying Upon Certain Properties of 55.1 Nitinol, by D. M. Goldstein et al., NOLTR 64-235, published Aug., 1965 by the U.S. Naval Ordinance Laboratory, White Oak, Maryland, pp. i-v, 1-31.

Transformation Pseudoelasticity and Deformation Behavior in a Ti-50.6at%Ni Alloy by S. Miyazaki et al., in Scripta Metallurgica, vol. 15, pp. 287-292, 1981, Pergamon Press Ltd, U.S.A.

Military Specification-Fittings, Tube, Fluid Systems, Separable, Dynamic Beam Seal, General Requirements for, MIL-F-85421, Feb. 11, 1981, U.S. Government Printing Office 1981-703 023 1155, pp. 1-20.

*Primary Examiner*—Deborah Yee

*Attorney, Agent, or Firm*—Herbert G. Burkard

[57] ABSTRACT

Disclosed are a group of nickel/titanium/niobium alloys wherein the niobium varies from about 2.5 to 30 atomic percent. Also disclosed is an aritcle made from these nickel/titanium/niobium alloys.

13 Claims, 8 Drawing Sheets

FIG__1

NICKEL/TITANIUM/NIOBIUM SHAPE MEMORY ALLOY & ARTICLE

RELATED APPLICATION

This application is a continuation of application Ser. No. 06/809,837, filed Dec. 13, 1985, which is a continuation of application Ser. No. 06/668,777, filed Mar. 6, 1984, both have been abandoned.

BACKGROUND OF THE INVENTION

This invention relates to the field of nickel titanium-based shape memory alloys and particularly to those alloys containing niobium.

Materials, both organic and metallic, capable of possessing shape memory are well known. An article made of such materials can be deformed from an original, heat-stable configuration to a second, heat-unstable configuration. The article is said to have shape memory for the reason that, upon the application of the heat alone, it can be caused to revert or attempt to revert from its heat-unstable configuration to its original heat-stable configuration, i.e., it "remembers" its original shape.

Among metallic alloys the ability to possess shape memory is a result of the fact that the alloy undergoes a reversible transformation from an austenitic state to a martensitic state with a change of temperature. Also, the alloy is considerably stronger in its austenitic state than in its martensitic state. This transformation is sometimes referred to as a thermoelastic martensitic transformation. An article made from such an alloy, for example, a hollow sleeve, is easily deformed from its original configuration to a new configuration when cooled below the temperature at which the alloy is transformed from the austenitic state to the martensitic state. The temperature at which this transformation begins is usually referred to as $M_s$ and the temperature at which it finishes $M_f$. When an article thus deformed is warmed to the temperature at which the alloy starts to revert back to austenite, referred to as $A_s$ ($A_f$ being the temperature at which the reversion is complete), the deformed object will begin to return to its original configuration.

Commercially viable alloys of nickel and titanium have been demonstrated to have shape-memory properties which render them highly useful in a variety of applications.

Shape-memory alloys have found use in recent years in, for example, pipe couplings (such as are described in U.S. Pat. Nos. 4,035,007 and 4,198,081 to Harrison and Jervis), electrical connectors (such as are described in U.S. Pat. No. 3,740,839 to Otte and Fischer), switches (such as are described in U.S. Pat. No. 4,205,293 to Melton and Mercier), etc., the disclosures of which are incorporated herein by reference.

It is, of course, advantageous to have the alloy austenitic at the service temperature which is often but not necessarily near room temperature, since the austenite phase is stronger than the martensite phase. In fact, it would be desirable to have the alloy remain austenitic over a wide range of service temperatures, for example from substantially below room temperature to substantially above room temperature, so that the alloy has practical utility.

As an illustration, Military Specification MIL-F-85421 requires a product that is functional to about −55° C. If the product comprises a shape memory alloy, then for convenience in shipping the product in the heat-unstable configuration, the product should not recover prior to about 50° C. It is a matter of commercial reality, within and without the military, that the product satisfy these or similar requirements.

It is also desirable that the alloy be martensitic in the vicinity of room temperature so that the article can be fabricated, stored, and shipped at or near room temperature. The reason for this is that in the case of an article made from the alloy, a coupling, for example, the article would not recover prematurely.

Conceptually, one way to achieve these desirable results, to wit, an alloy that is martensitic near room temperature and which is also austenitic over a large range of temperatures including room temperature, is to have an alloy which exhibits a sufficiently wide tranformation hysteresis, say, greater than about 125° C. If the hysteresis were sufficiently wide and room temperature could be located near the middle of the hysteresis, then the alloy could be fabricated and conveniently stored while in the martensitic condition. Since the hysteresis is sufficiently wide, the alloy would not transform to austenite until heated substantially above room temperature. This heating would not be applied until the alloy (in the form of a coupling, for example) was installed in its intended environment. The alloy, which would then be in the austenitic condition, would remain in the austenitic condition after cooling down since the service temperature (which may be above or below room temperature) would be substantially above the martensite transformation temperature. Thus, the above-noted desirable results could be achieved.

Unfortunately, there is believed to be no commercially viable nickel/titanium-based alloy that has a hysteresis sufficiently wide to achieve these desirable results.

For example, the commercially viable near equiatomic binary nickel-titanium alloys can have a hysteresis width of about 30° C. The location of the hysteresis for this alloy is also extremely composition sensitive so that while the hysteresis can be shifted from sub-zero temperatures to above-zero temperatures, the width of the hysteresis does not appreciably change. Thus, if the alloy were martensitic at room temperature, the service temperature must be above room temperature. Similarly, if the service temperature was at room temperature, the alloy would be martensitic below room temperature so that the alloy would require special cold-temperature equipment for fabrication, shipping, and storage. Ideally, as discussed above, room temperature should be located near the middle of the transformation hysteresis. However, since the width of the hysteresis in the binary alloy is so narrow, the range of service temperatures for any particular alloy is necessarily limited. As a practical matter, the alloy would have to be changed to accommodate any change in service temperatures.

It can be appreciated that the relative lack of commercialization of shape memory alloys must be due, at least in part, to their extreme sensitivity to temperatures as discussed above. Alloying and processing have not solved the problem.

Nickel/titanium/iron alloys, e.g., those in Harrison et al., U.S. Pat. No. 3,753,700, while having a wide hysteresis, up to about 70° C., are the typical cryogenic alloys which always undergo the martensite/austenite transformation at sub-zero temperatures. It should be noted that in general, the colder shape-memory alloys such as the cryogenic alloys have a wider transformation hysteresis than the warmer shape memory alloys. In the case of the cryogenic alloys, the alloys must be kept very cold, usually in liquid nitrogen, to avoid the transformation from martensite to austenite. This makes the use of shape memory alloys inconvenient, if not uneconomical.

The nickel/titanium/copper alloys of Harrison et al., U.S. patent application Ser. No. 537,316, filed Sept. 28, 1983, and the nickel/titanium/vanadium alloys of Quin, U.S. patent application Ser. No. 541,844, filed Oct. 14, 1983, now U.S. Pat. No. 541,844 are not cryogenic but their hysteresis may be extremely narrow (10°–20° C.) such that their utility is limited for couplings and similar articles.

Nickel/titanium/niobium alloys are largely unexplored. The ternary phase diagram has been determined [see "Ternary Intermetallic Compounds in the System Ni-Ti-Nb", *Poroshkovaya Metallurgiya,* No. 8(44), pp. 61–69 (1966)] but there has been no study of the physical properties in this system. U.S. Naval Ordinance Laboratory Report NOLTR 64-235 (August, 1965) examined the effect upon hardness of ternary additions of from 0.08 to 16 weight percent of eleven different elements (including niobium) to stoichiometric nickel/-titanium.

The problems experienced with the nickel/titanium-based shape memory alloys have been somewhat overcome by processing in the copper-based shape memory alloys. It is now known that the hysteresis in copper-based shape memory alloys can be temporarily expanded by mechanical preconditioning, austenitic aging and heat treating. In this regard, see Brook et al., U.S. Pat. Nos. 4,036,669; 4,067,752; and 4,095,999.

The methods of the Brook et al. patents have been applied to nickel/titanium-based alloys; however, it has been found that these methods have no beneficial effect on nickel/titanium-based alloys.

It is known that under certain conditions the hysteresis of nickel/titanium-based alloys can be shifted as opposed to expanded. It should be understood that shifting of the hysteresis means that the $M_s$, $M_f$, $A_s$, and $A_f$ temperatures have all been translated to $M_s'$, $M_f'$, $A_s'$ and $A_f'$ such that there is substantially no change in the width of the hysteresis. It should be noted that the translated transformation temperatures may be higher or lower than the normal transformation temperatures. On the other hand, expansion of the hysteresis should generally be understood to mean that $A_s$ and $A_f$ have been elevated to $A_s'$ and $A_f'$ while at least $M_s$ and usually also $M_f$ remain essentially constant. Aging, heat treatment, composition, and cold work can all effectively shift the hysteresis. For example, if the stress is applied to the shape memory alloy at room temperature the hysteresis may be shifted so that the martensite phase can exist at a temperature at which there would normally be austenite. Upon removal of the stress, the alloy would isothermally (or nearly isothermally) transform from martensite to austenite.

Miyazaki et al., ("Transfomation Pseudoelasticity and Deformation Behavior in a Ti-50.6 at % Ni Alloy", *Scripta Metallurgica,* vol. 15, no. 3, pp. 287–292, (1981) have studied the deformation behavior of binary nickel-titanium alloys. As implied in FIG. 3 of this reference, the austenite transformation temperatures can be elevated when nonrecoverable strain is imparted to the alloy. That is, when the alloy was strained to 8% or higher and the stress then removed, there was some component of the strain which remained at the deformation temperature of 243° K. (compared to an $A_f$ of 221° K.). This component recovered when heated to 373° K. (see dotted lines on FIG. 3) although the precise recovery temperature was never measured. It is not clear from this reference whether the hysteresis was shifted or expanded since the binary nickel-rich alloy tested is extremely unstable when rapidly quenched as was done in this reference. In fact, one skilled in the art would have concluded that the hysteresis was shifted and not expanded due to the unstable alloy tested. There is no illustration of the transformation hysteresis to contradict this conclusion.

In the Melton et al. patent previously mentioned, a nickel/titanium/copper alloy was deformed beyond a critical strain so as to impart nonrecoverable strain. However, no expansion of the transformation hysteresis was reported.

While it can be appreciated that it would be desirable to have a nickel/titanium-based shape memory alloy and article with a sufficiently wide transformation hysteresis, the prior art has thus far remained silent on a way to achieve it.

Thus, it is an object of the invention to have a nickel/-titanium-based shape memory alloy which is capable of having a wide transformation hysteresis.

Another problem common to nickel/titanium-based shape memory alloys is their notoriously poor machinability. Of course, while nickel/titanium-based shape memory alloys can be machined, it is only with expensive tooling and then only in relatively simple shapes.

It can be appreciated that a free-machining nickel/-titanium-based shape memory alloy would be extremely desirable. Unfortunately, the prior art has also remained silent on how to achieve such an alloy.

Thus, it is another object of the invention to have a nickel/titanium-based shape memory alloy that is free-machining.

Still another problem with shape memory alloys is that many alloys transform to an "R" phase at temperatures above the normal martensite transformation temperature. The R phase is a transitional phase between austenite and martensite. Generally, in alloys with $M_s$ temperatures below −70° C., the R phase becomes manifest at significantly higher temperatures. In couplings, the R phase transformation leads to a relaxation of stresses upon cooling before the $M_s$ temperature is reached.

It would be desirable to have an alloy with no deleterious R phase transformaton. That is, it is desirable to have an alloy with an R phase transformation at as low a temperature as possible or at least an R phase transformation that does no interfere with the austenite/martensite transformation. Most desirable is no R phase transformation at all.

Thus, it is a further object of the invention to have a nickel/titanium-based shape memory alloy that does not experience a deleterious R phase transformation.

While it is certainly desirable that the shape memory alloy have a wide transformation hysteresis, be free-machining and not exhibit a deleterious R phase transformation, it is important to appreciate and understand that recovery strength, ductility, and stability also remain important considerations when choosing a shape memory alloy.

Thus, it is a still further object of the invention to have a nickel/titanium-based shape memory alloy which is exemplary with respect to recovery strength, ductility, and stability.

These and other objects of the invention will become apparent to those skilled in the art after reference to the following description considered in conjunction with the accompanying drawings.

BRIEF DESCRIPTION OF THE INVENTION

We have discovered a group of nickel/titanium/niobium alloys that are extremely susceptible to a widening of their transformation hysteresis and that do not exhibit a deleterious R phase transformation. For the most part, these alloys are also free-machining. The disclosed alloys contain about 2.5 to 30 atomic percent niobium.

DETAILED DESCRIPTION TO THE INVENTION

Figure 1:
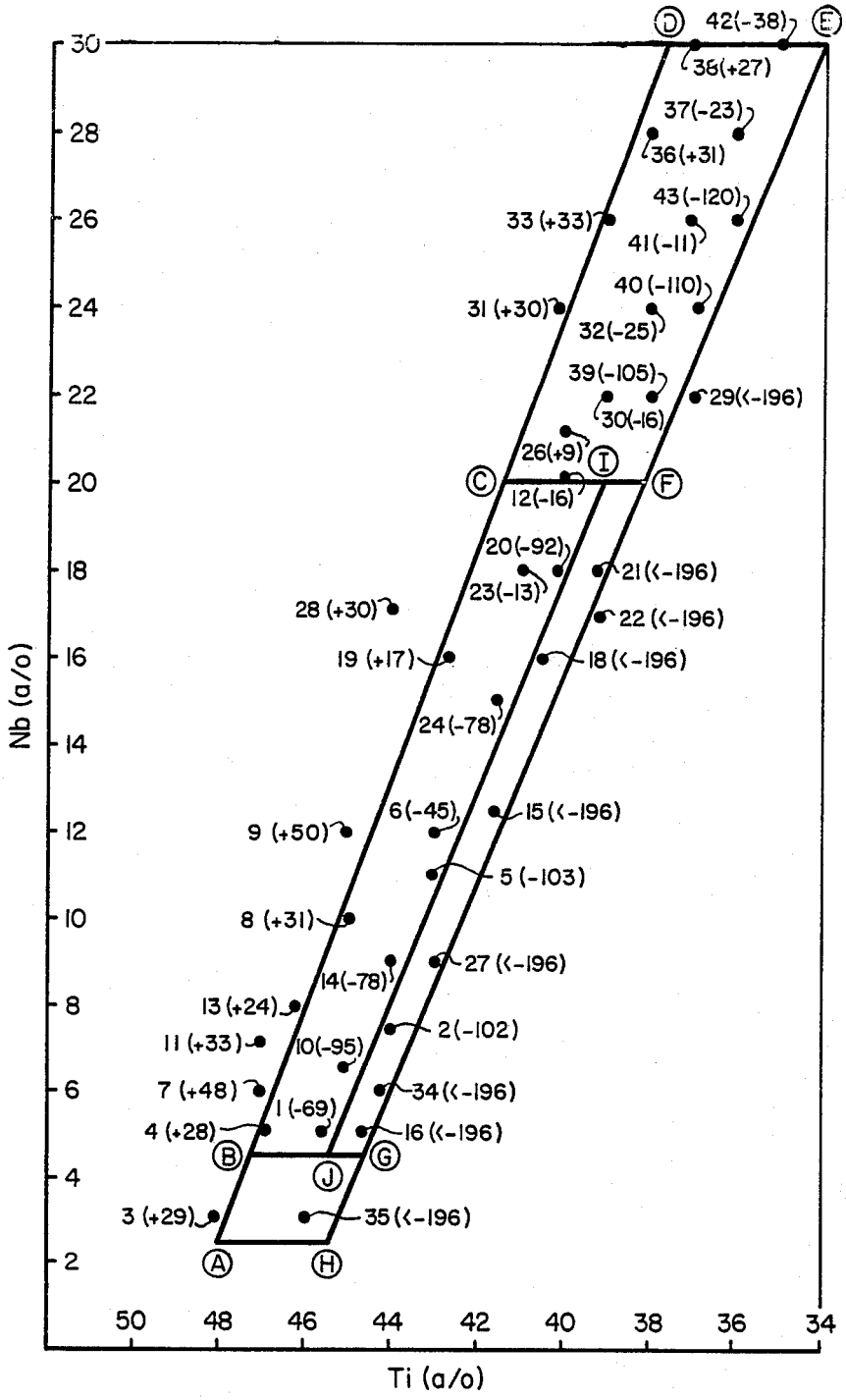
FIG. 1 is a pseudo-binary phase diagram illustrating the relationship of $M_s$ temperature to the compositional are claimed according to the invention.

Referring to the figures in detail and particularly referring to FIG. 1, there is illustrated a pseudo-binary phase diagram for the nickel/titanium/niobium system. The titanium composition may be read on the horizontal axis and the niobium composition may be read on the vertical axis. The nickel composition may be obtained by adding the titanium and niobium compositions and subtracting from 100. All compositions are in atomic percent.

The claimed composition in FIG. 1 is generally bounded by area ADEH. The composition for each of the vertices is given in Table 1.

TABLE 1

| | Ti(a/o) | Ni(a/o) | Nb(a/o) |
|---|---|---|---|
| A | 48 | 49.5 | 2.5 |
| D | 37.5 | 32.5 | 30 |
| E | 33.7 | 36.3 | 30 |
| H | 45.5 | 52 | 2.5 |

Compositions to the left of AD have an $M_s$ temperature that is too high and compositions to the right of EH have an $M_s$ temperature that is too cold (substantially below liquid nitrogen).

As will become clear hereafter, alloys within area ADEH are very susceptible to having their transformation hysteresis enlarged; however, in those compositions below line AH, the enlargement is too small to be of practical utility.

It has been found that compositions with higher niobium contents above line DE have too little shape memory effect to be of practical utility as will become apparent hereafter.

A particularly preferred composition is circumscribed by area BDEG on FIG. 1. The composition for each of the vertices is given in Table 2.

TABLE 2

| | Ti(a/o) | Ni(a/o) | Nb(a/o) |
|---|---|---|---|
| B | 47.24 | 48.26 | 4.5 |
| D | 37.5 | 32.5 | 30 |
| E | 33.7 | 36.3 | 30 |
| G | 44.64 | 50.86 | 4.5 |

As before, lines BD and EG provide boundaries for compositions having the proper range of $M_s$ temperatures. Similarly, line DE provides the upper limit of the niobium content.

Line BG now provides the lower boundary for the free-machining alloys such that all alloys within BDEG are free-machining. It is expected that alloys with higher niobium contents above line DE would also be free-machining but are excluded from the alloys according to the invention due to the small shape memory effect present, as mentioned above. The fact that the alloys according to the invention are free-machining was surprising and totally unexpected.

While not wishing to be held to any particular theory, it is believed that the free-machining character of these alloys is due to the presence of a eutectic phase in addition to the primary shape memory phase. With compositions below BG, the eutectic phase is nonexistent or is present in such small quantities as to be of little use. For alloys of greater niobium content than the line CF, the niobium-rich rather than the shape memory phase becomes the primary phase, and the machinability of these high niobium content alloys although somewhat improved compared to normal nickel/titanium-based alloys, is not as good as within the range BCFG.

Another particularly preferred composition is that circumscribed by area BCFG on FIG. 1. The composition for each of the vertices is given in Table 3.

Lines BC and FG, again, mark the boundaries for acceptably high and low $M_s$ values, respectively. Also, BG delineates the lower limit of machinability.

TABLE 3

| | Ti(a/o) | Ni(a/o) | Nb(a/o) |
|---|---|---|---|
| B | 47.24 | 48.26 | 4.5 |
| C | 41.32 | 38.68 | 20 |
| F | 38 | 42 | 20 |
| G | 44.64 | 50.86 | 4.5 |

Now, line CF provides a boundary between compositions having different recovery forces as well as different machinabilities, as just discussed. On FIG. 1, those compositions below line CF have a higher recovery force than those compositions above line CF. The import of this will become apparent hereafter.

The most preferred compositions are those in area BCIJ. The bounds of this area are given in Table 4.

TABLE 4

| | Ti(a/o) | Ni(a/o) | Nb(a/o) |
|---|---|---|---|
| B | 47.24 | 48.26 | 4.5 |
| C | 41.32 | 38.68 | 20 |
| I | 39 | 41 | 20 |
| J | 45.5 | 50 | 4.5 |

Lines CI and BJ have been drawn to optimize recovery force and machinability. Lines BC and IJ have been drawn to optimize the desired $M_s$ temperatures and the expansion of the transformation hysteresis.

It is believed that the most commercially viable alloys will be located in this area.

The advantages of the invention will become more apparent after reference to the following examples.

EXAMPLES I

Commercially pure titanium, carbonyl nickel and niobium were weighed in proportions so as to give the compositions in atomic percent listed in Tables 5 and 6. The total mass for test ingots was about 330 grams. These metals were placed in a water-cooled, copper hearth in the chamber of an electron beam melting furnace. The chamber was evacuated to $10^{-5}$ Torr and the charges were melted and was alloyed by use of the electron beam.

The resulting ingots were hot swaged and hot rolled in air at approximately 850° C. to produce a strip of approximately 0.025-in. thickness. Samples were cut from the strip, descaled and vacuum annealed at 850° C. for 30 minutes and furnace cooled.

In the first group of samples, those listed in Table 5, the $M_s$ for each sample was measured at a load of 10 ksi. Where the samples had an $M_s$ less than liquid nitrogen (−196° C.), the $M_s$ was noted as simply less than −196° C. The results are tabulated in Table 5 and plotted on FIG. 1. The numbers next to each data point in FIG. 1 are the alloy numbers and numbers in parentheses are the $M_s$ values.

Referring now to FIG. 1, the reasons for the claimed composition range bounded by area ADEH become more apparent. Thus, it can be seen that compositions to the left of line AD have an $M_s$ of about 30° C. or higher. Since this $M_s$ is higher than room temperature, the utility of those alloys to the left of line AD is necessarily limited for coupling, fastener, or similar type applications.

Compositions to the right of line EH have an $M_s$ substantially less than −196° C. Of course, it is conceivable that these alloys may have some utility (e.g., as replacement for the Ni/Ti/Fe cryogenic alloys of Harrison, et al. as noted in the Background of the Invention) but for the instant invention, these compositions will not fulfill the objects of the invention.

Line IJ defines a constant $M_s$ of about −80° C. Compositions to the right of line IJ will have a colder $M_s$ and compositions to the left of line IJ will have a warmer $M_s$. An $M_s$ of −80° C. is an important number since this means that the composition will have acceptable strength at about −55° C. (there being a strength minimum at $M_s$) and thus will meet the previously noted Military Specification.

It should be noted then, that those compositions between lines IJ and BC define the most preferred range based on the $M_s$ temperature.

In the second group of samples, those listed in Table 6, each sample was elongated. After elongation the stress was removed and the strip was heated unrestrained so as to effect recovery of the shape memory alloy. The recovery was monitored and plotted as a function of temperature. When the transformation was complete, the sample was cooled and then reheated so as to complete the measurement of the martensite and austenite transformation temperatures before recovery and after recovery.

TABLE 5

| Alloy No. | Ti | Ni | Nb | *$M_s$, °C. |
|---|---|---|---|---|
| 1 | 45.5 | 49.5 | 5 | −69 |
| 2 | 44 | 48.5 | 7.5 | −102 |
| 3 | 48 | 49 | 3 | 29 |
| 4 | 47 | 48 | 5 | 28 |
| 5 | 43 | 46 | 11 | −103 |
| 6 | 43 | 45 | 12 | −45 |
| 7 | 47 | 47 | 6 | 48 |
| 8 | 45 | 45 | 10 | 31 |
| 9 | 45 | 43 | 12 | 50 |
| 10 | 45 | 48.5 | 6.5 | −95 |
| 11 | 47 | 46 | 7 | 33 |
| 12 | 40 | 40 | 20 | −16 |
| 13 | 46 | 46 | 8 | 24 |
| 14 | 44 | 47 | 9 | −78 |
| 15 | 41.5 | 46 | 12.5 | <−196 |
| 16 | 44.5 | 50.5 | 5 | <−196 |
| 18 | 40.5 | 43.5 | 16 | <−196 |
| 19 | 42.5 | 41.5 | 16 | 17 |
| 20 | 40 | 42 | 18 | −92 |
| 21 | 39 | 43 | 18 | <−196 |
| 22 | 39 | 44 | 17 | <−196 |
| 23 | 41 | 41 | 18 | −13 |
| 24 | 41.5 | 43.5 | 15 | −78 |
| 26 | 40 | 39 | 21 | 9 |
| 27 | 43 | 48 | 9 | <−196 |
| 28 | 44 | 39 | 17 | 30 |
| 29 | 37 | 41 | 22 | <−196 |
| 30 | 39 | 39 | 22 | −16 |
| 31 | 40 | 36 | 24 | 30 |
| 32 | 38 | 38 | 24 | −25 |
| 33 | 39 | 35 | 26 | 33 |
| 34 | 44 | 49.5 | 6.5 | <−196 |
| 35 | 46 | 51 | 3 | <−196 |
| 36 | 38 | 34 | 28 | 31 |
| 37 | 36 | 36 | 28 | −23 |
| 38 | 37 | 33 | 30 | 27 |
| 39 | 38 | 40 | 22 | −105 |
| 40 | 37 | 39 | 24 | −110 |
| 41 | 37 | 37 | 26 | −11 |
| 42 | 35 | 30 | 30 | −38 |
| 43 | 36 | 38 | 26 | −120 |

*Ms measured at 10 ksi load

As explained in more detail in our co-pending application, the elongation of the sample will act to expand the transformation hysteresis such that the austenite transformation temperatures, $A_s$ and $A_f$ will be temporarily raised to $A_s'$ and $A_f'$. For the most part, the martensite transformation temperatures, $M_s$ and $M_f$, will remain essentially constant. The measure $A_s'$ minus $M_s$ defines an operating range. That is, the $M_s$ value will be indicative of the lower temperature limit of functionality of the sample and $A_s'$ is indicative of the highest temperature the sample may be exposed to before the sample will transform to austenite. After the sample transforms to austenite, the hysteresis will shrink to $A_s-M_s$. Thus, $A_s'-M_s$ is a useful indicator of the expansion of the hysteresis. For the purposes of this application, $A_s'-M_s$ will also be useful in indicating the preconditionability of each composition wherein the transformation hysteresis can be temporarily expanded prior to use.

Figure 2:
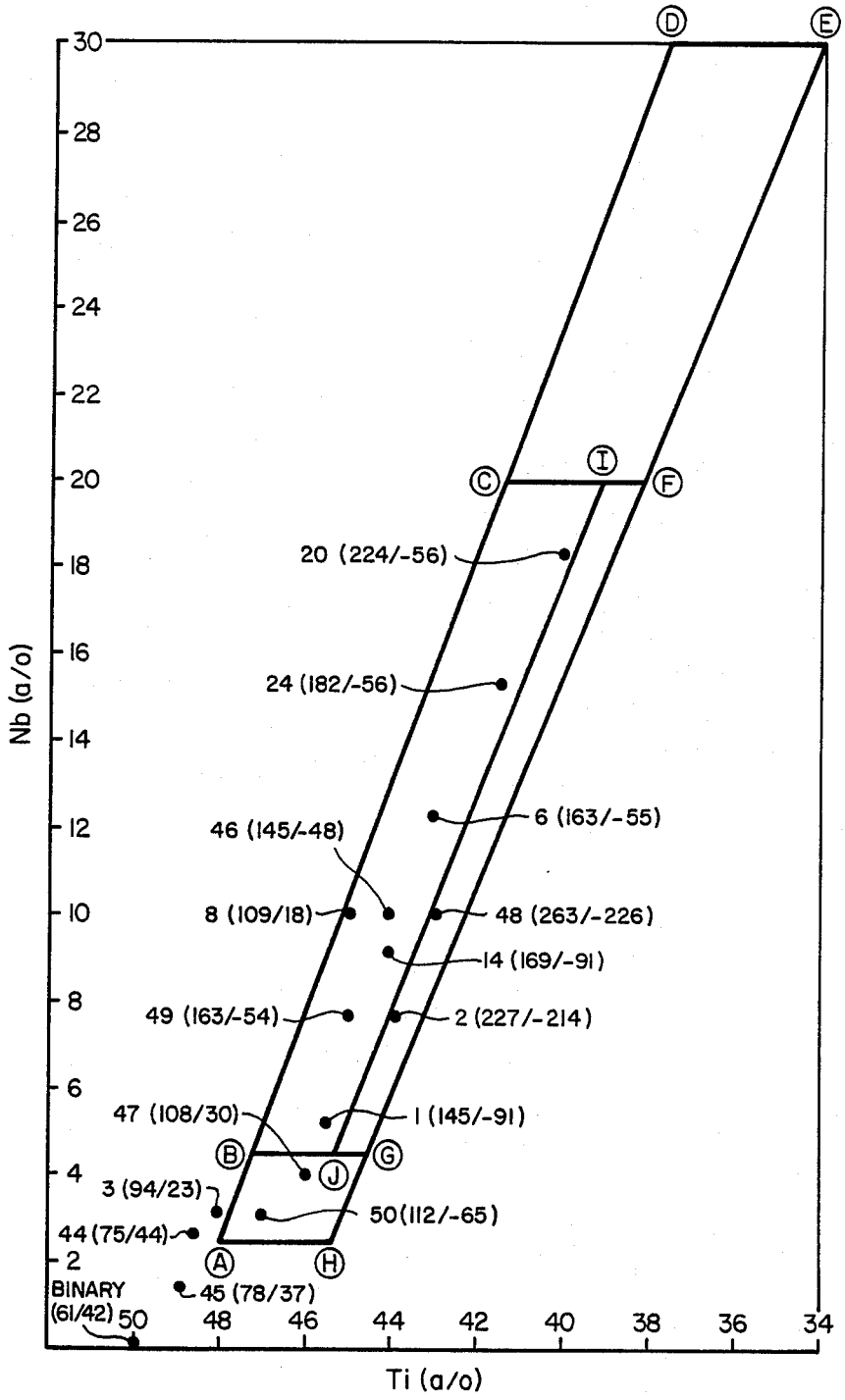
FIG. 2 is a pseudo-binary phase diagram illustrating the relationship of preconditionability to the compositional area claimed according to the invention.

The results are tabulated in Table 6 and plotted on FIG. 2. It must be noted that the $M_s$ values in Table 6 were either measured at zero load or were measured at higher loads and then extrapolated to zero load.

Line AH at the bottom of FIG. 2 was determined to be the dividing line between those compositions having practical preconditionability and those compositions not having practical preconditionability. The preconditionability number ($A_s'-M_s$) is the top number in parentheses at each data point and $M_s$ is the bottom number. The other number at each data point is the alloy number. The preconditionability does not substantially change until about 2.5% niobium (line AH). Compositions to the left of line AD and above 2.5% niobium have a preconditionability of less than about 100° C. and are unsuitable, in any event, since they have an $M_s$ that is too warm. Compositions to the right of line AD and above 2.5% niobium have a preconditionabilty over about 100° C.

TABLE 6

| Alloy No. | Ti | Ni | Nb | $A_s'$-$M_s$, °C. | $M_s$, °C.* |
|---|---|---|---|---|---|
| Binary | 50 | 50 | 0 | 61 | 42 |
| 44 | 48.5 | 49.5 | 2 | 75 | 44 |
| 45 | 48.75 | 49.75 | 1.5 | 78 | 37 |
| 46 | 44 | 46 | 10 | 145 | −48 |
| 1 | 45.5 | 49.5 | 5 | 145 | −91 |
| 2 | 44 | 48.5 | 7.5 | 227 | −214 |
| 3 | 48 | 49 | 3 | 94 | 23 |
| 6 | 43 | 45 | 12 | 163 | −55 |
| 8 | 45 | 45 | 10 | 109 | 18 |
| 47 | 46 | 50 | 4 | 108 | 30 |
| 48 | 43 | 47 | 10 | 263 | −226 |
| 14 | 44 | 47 | 9 | 169 | −91 |
| 49 | 45 | 47.5 | 7.5 | 163 | −54 |
| 20 | 40 | 42 | 18 | 224 | −56 |
| 24 | 41.5 | 43.5 | 15 | 182 | −56 |
| 50 | 47 | 50 | 3 | 112 | −65 |

*$M_s$ at zero load.

In general, preconditionability will increase from low niobium content toward higher niobium content for any given constant $M_s$ value. For example, composition 24 (15% niobium) is more preconditionable than composition 6 (12% niobium), even though both have a similar $M_s$.

Also, in general, preconditionability will increase with decreasing titanium content for any given niobium content. Thus, comparing compositions 8, 46, and 48, all of which have a niobium content of 10 atomic percent, the preconditionability increases from 109 to 263 while titanium content decreases from 45 to 43 atomic percent.

A third group of samples was examined to determine their microstructure. The compositions of the samples examined are listed below in Table 7 and plotted on FIG. 3.

Figure 4:
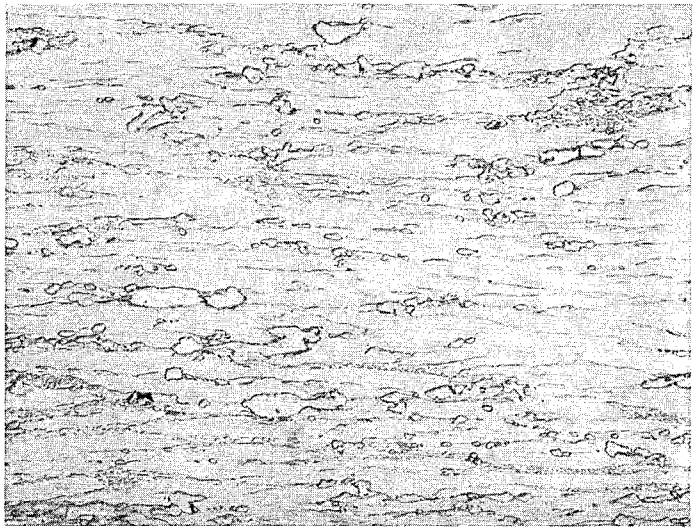
FIG. 4 is a photomicrograph of an alloy outside the scope of the invention.

Alloys to the left of line BD contain a third, coarse phase in addition to the primary (shape memory) phase and the eutectic. The eutectic structure, if present, tends to be rather coarse, too. In this regard, see FIG. 4 (alloy 51).

TABLE 7

| Alloy No. | Ti | Ni | Nb |
|---|---|---|---|
| 35 | 46 | 51 | 3 |
| 51 | 49 | 43 | 8 |
| 30 | 39 | 39 | 22 |
| 14 | 44 | 47 | 9 |
| 21 | 39 | 43 | 18 |

Figure 5:
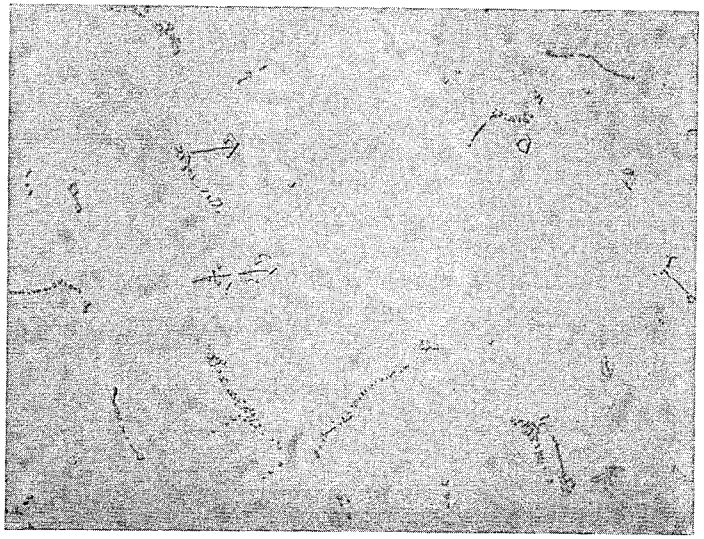
FIGS. 5 through 8 are photomicrographs of alloys according to the invention.

Alloys below line BG, exemplified by alloy 35, contain very small amounts of eutectic, usually less than about 5 volume percent. The microstructure can be seen in FIG. 5.

Figure 6:
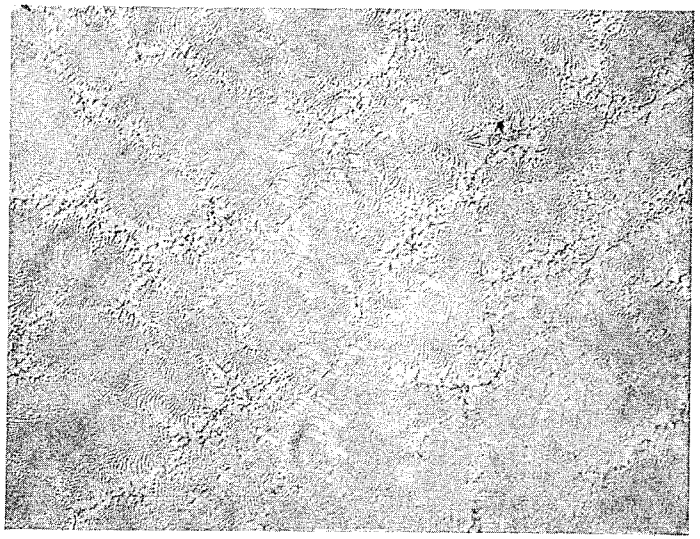

Those alloys having a niobium content above line CF, such as alloy 30, contain primarily the eutectic plus a second phase consisting of almost pure niobium (see FIG. 6).

Figure 3:
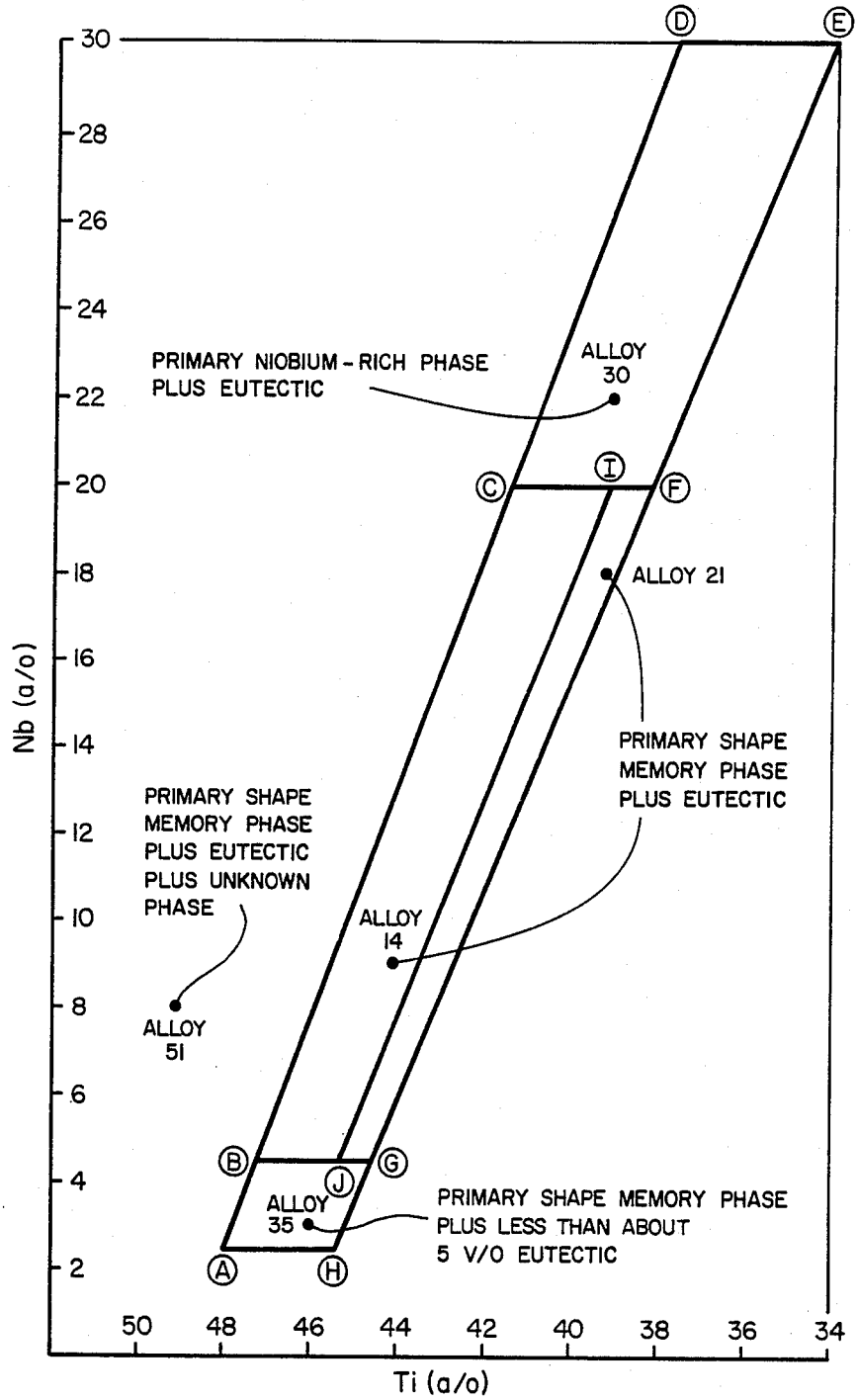
FIG. 3 is a pseudo-binary phase diagram illustrating the relationship of microstructure to the compositional area claimed according to the invention.
Figure 7:
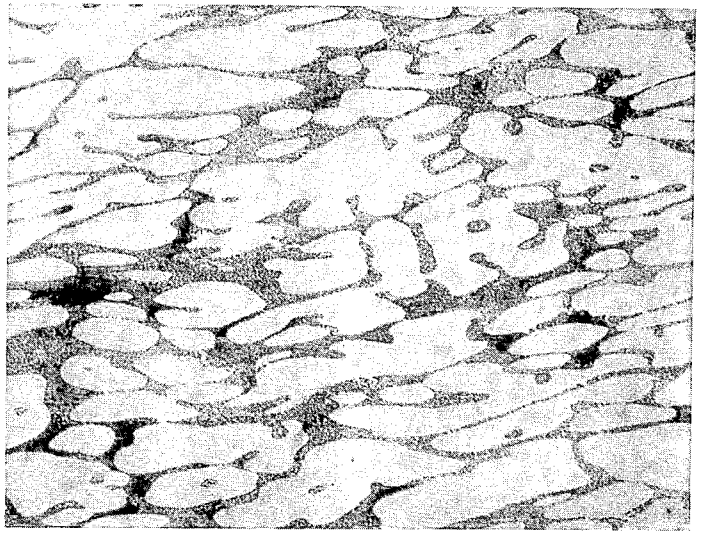
Figure 8:
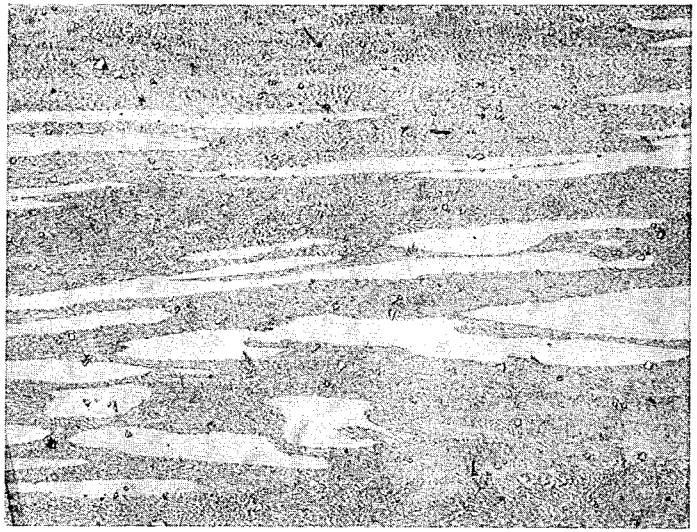

The area within BCFG in FIG. 3 is exemplified by alloy 14 and alloy 21. The microstructures can be seen in FIGS. 7 and 8, respectively. The microstructure is characterized by the primary (shape-memory) phase in the form of dendrites plus an interdentritic eutectic network. The eutectic appears to consist of the primary phase plus essentially pure niobium. During working the eutectic network is broken up and the alloy becomes more homogeneous on a microscopic scale. Generally speaking, the volume fraction of eutectic increases with increasing niobium. Compare alloy 14 (FIG. 7) with alloy 21 (FIG. 8). For a given niobium content, the eutectic appears to coarsen with increasing titanium content. By way of example, alloy 14 has a very fine eutectic.

The presence of the eutectic results in a very fine-grained two-phase microstructure after hot working. Alloys with this microstructure have excellent formability and, for example, may be cold worked at room temperature. By way of illustration, an alloy having the nominal composition of 44 atomic percent titanium, 47 atomic percent nickel, and 9 atomic percent niobium, (the above alloy 14) was cold drawn to 0.025-inch diameter wire from 0.5-inch bar with interpass anneals at 850° C. The same alloy could also be hot rolled to form sheet which could then be cold rolled as a finishing operation.

Unexpectedly, it has been found that the alloys having enhanced machinability are located within area BDEG, the area having the greatest amount of the eutectic composition. Even more unexpectedly, the alloys within area BCFG have greatly enhanced machinability for reasons which will become apparent shortly. Generally, it has been found that machinability increases with increasing eutectic.

Again, while not wishing to be held to any particular theory, it is believed that the eutectic in area BCFG is presented as a phase with different mechanical properties than the matrix and, accordingly, promotes chip break-up in much the same way as a free-machining steel or brass. It was found that when the volume percent of eutectic was 5% or greater, improved machinability was observed. With the eutectic less than about 5 volume percent, the desired effect was not observed. In area CDEF, the eutectic is presented as the major constituent, which has better machinability than the primary shape memory phase (as found, e.g., in normal nickel/titanium-based alloys), but not as good as where it surrounds the primary shape memory phase as in area BCFG.

A further manifestation of the improved machinability was a decrease in observed tool wear. A given tool was found to machine more parts before its replacement became necessary.

EXAMPLES II

Samples were prepared in the same mannner as those in Examples I. Each sample was deformed 14% (except where noted), unloaded, heated, and then allowed to freely recover 3%. Each sample was then restrained (strain rate set at zero) so as to build up a stress, which was then measured.

The purpose of this test was to simulate the behavior of a coupling. The 3% free recovery was for the purpose of demonstrating the taking up of tolerances. After the 3% free recovery, the coupling would come up against the substrate (the pipe) which would act as a virtually immovable object. At this point, the coupling would continue to attempt to recover, thereby building up to a maximum stress. The maximum stress ($\sigma_{max}$)

measured is a reliable indicator of the recovery force of the coupling.

The results are tabulated in Table 8.

TABLE 8

| Alloy No. | Ti(a/o) | Ni(a/o) | Nb(a/o) | $\sigma_{max}$, ksi |
|---|---|---|---|---|
| 6 | 43 | 45 | 12 | 52.5 |
| 24 | 41.5 | 43.5 | 15 | 51.8 |
| 50 | 47 | 50 | 3 | 41.7 |
| 27 | 43 | 48 | 9 | 66.9 |
| 30 | 39 | 39 | 22 | 18 |
| 36* | 38 | 34 | 28 | — |
| 37 | 36 | 36 | 28 | 19 |
| 38+ | 37 | 33 | 30 | 0 |

*deformed, 11%; sample broke
+deformed 12%; free recovery less than 3%

The first four samples are located below line CF. The last four samples are above line CF. The comparison of the two sets of samples is most revealing.

Compositions above line CF clearly have less recovery force than those below line CF. Thus, it is expected that the latter compositions will have somewhat greater utility than the former compositions. It should be understood, however, that compositions above line CF (but below line DE) will still have practical utility and will also satisfy the objects of the invention.

Alloy 38 is on the border between the alloys according to the invention and the alloys not within the scope of the invention. The reason for this demarcation can be explained as follows. It is noted that alloy 38 had zero recovery force. This result is due to the fact that the shape memory effect in this particular composition (as well as other compositions having greater than about 30 percent niobium) is so small that there was not enough shape memory recovery to take up the 3 percent simulated tolerance. The small shape memory effect is due, it is believed, to the reduced volume fraction present of the shape memory phase. Accordingly, it is believed that compositions beyond line DE will have little practical utility.

EXAMPLES III

It has been found that the properties of the alloys according to the invention can be influenced to varying degrees by processing. As will become apparent hereafter, the properties of any particular alloy can be tailored to fit a particular set of requirements by application of the following preferred processing methods.

It is known that processing such as cold working plus warm annealing or warm working plus warm annealing can be used to influence and control the properties of nickel/titanium-based shape memory alloys. In this regard, the disclosures of U.S. Ser. No. 553,005 (filed Nov. 15, 1983) and U.S. Ser. No. 596,771 (filed Apr. 4, 1984) are hereby incorporated by reference. These methods can also be applied to the alloys according to the invention and, in fact, result in properties that are distinctly different from the conventional hot working plus hot annealing processing method.

In a first group of samples, the zero load $M_s$ temperature was determined as a function of processing temperature for an alloy consisting essentially of 44 atomic percent titanium, 47 atomic percent nickel, and 9 atomic percent niobium. Three of the samples were warm worked and warm annealed at temperatures ranging from 400°–600° C. and three of the samples were hot worked at temperatures between 850° and 900° C. and then hot annealed at temperatures between 850° and 1050° C. The results are tabulated in Table 9.

TABLE 9

| Sample No. | Working Temperature °C. | Annealing Temperature °C. | $M_s$, °C.* |
|---|---|---|---|
| 1 | 400 | 400 | −218 |
| 2 | 500 | 500 | −184 |
| 3 | 600 | 600 | −170 |
| 4 | 850–900 | 850 | −94 |
| 5 | 850–900 | 950 | −70 |
| 6 | 850–900 | 1050 | −62 |

*extrapolated to zero load

Thus, it can be seen that thermo-mechanical processing can be applied to these alloys to control the temperature of transformation.

In the above samples 2 through 6, the intrinsic width of the transformation hysteresis (defined as $A_f$ minus $M_s$) was determined at zero load as a function of the processing temperature. The results are tabulated in Table 10.

TABLE 10

| Sample No. | Working Temperature °C. | Annealing Temperature °C. | $A_f$-$M_s$, °C. (zero load) |
|---|---|---|---|
| 2 | 500 | 500 | 44 |
| 3 | 600 | 600 | 66 |
| 4 | 850–900 | 850 | 45 |
| 5 | 850–900 | 950 | 40 |
| 6 | 850–900 | 1050 | 47 |

It should be noted that these samples were not preconditioned as previously described. From Table 10, it can be seen that the intrinsic width of the hysteresis appears to be optimized by warm working plus warm annealing at 600° C.

Furthermore, preconditionability is also improved by warm working and warm annealing. Rings of the above alloy were enlarged 16% at −50° C. after warm working/warm annealing at 600° C. or hot working/hot annealing at 850° C. The rings were heated and allowed to freely recover so that $A_s'$ could be measured. The warm worked/warm annealed ring had an $A_s'$ of 40° C. From Table 9, $M_s$ was −170° C. Therefore $A_s'-M_s$ is 210° C. Similarly, the hot worked/hot annealed ring had an $A_s'$ of 52° C. and an $M_s$ of −94° C. so that $A_s'-M_s$ is 146° C. Thus, the operating range of the alloy, $A_s'-M_s$, has been increased by 64° C. by optimizing processing conditions.

The effect of processing upon austenitic yield strengths was studied. In this case, two samples were made from an alloy consisting essentially of 45 atomic percent Ti, 47 atomic percent nickel, and 8 atomic percent niobium. One sample was hot worked and hot annealed (for 30 minutes) at 850° C. and the other was warm worked and warm annealed (for 30 minutes) at 500° C. The $M_s$ at 10 ksi and the austenitic yield strengths were measured. The hot worked/hot annealed sample had an $M_s$ of −5° C. and an austenitic yield strength of 82 ksi. The warm worked/warm annealed sample had an $M_s$ of −47° C. and an austenitic yield strength of 96 ksi.

Thus, processing can be used to control the strength, as well as the transformation temperature, of the disclosed alloys.

In another group of samples, the effect of cold working/warm annealing versus hot working/hot annealing was studied. The samples were made from an alloy consisting essentially of 46 atomic percent nickel, 46 atomic percent titanium, and 8 atomic percent niobium. One sample had a 10 ksi $M_s$ of 24° C. after hot working and hot annealing at 850° C. Another sample had a 10 ksi $M_s$ of 3° C. after cold rolling and then warm annealing at 500° C. The room temperature austenitic yield strength was raised from 78 ksi (hot worked/hot annealed) to 132 ksi by cold rolling and warm annealing.

Thus, cold working combined with an appropriate annealing temperature can also be used to control the strength and transformation temperature of the disclosed alloys.

It has also been found that heat treatment alone can affect the transformation temperature. The results are tabulated in Table 11.

TABLE 11

| | $M_s$ at 30 ksi, °C. | |
|---|---|---|
| Alloy (a/o) | 850 anneal + water quench | 850 anneal + water quench + 2 hr @ 400° C. |
| 44 Ti/48.5 Ni/7.5 Nb | −108 | −115 |
| 43 Ti/47 Ni/10 Nb | −93 | −128 |
| 44 Ti/47 Ni/9 Nb | −43 | −20 |

Thus, depending upon composition, $M_s$ can be either raised or lowered by heat treatment.

It will be obvious to those skilled in the art having regard to this disclosure that other modifications of this invention beyond those embodiments specifically described here may be made without departing from the spirit of the invention. Accordingly, such modifications are considered within the scope of the invention as limited solely by the appended claims.

We claim:

1. A shape memory alloy, which has been thermo-mechanically treated to exhibit shape memory properties, comprising nickel, titanium, and niobium within an area defined on a nickel, titanium, and niobium pseudo-binary phase diagram by a quadrilateral with its first vertex at 48 atomic percent titanium, 49.5 atomic percent nickel, and 2.5 atomic percent niobium; its second vertex at 37.5 atomic percent titanium, 32.5 atomic percent nickel, and 30 atomic percent niobium; its third vertex at 33.7 atomic percent titanium, 36.3 atomic percent nickel, and 30 atomic percent niobium; and its fourth vertex at 45.5 atomic percent titanium, 52 atomic percent nickel, and 2.5 atomic percent niobium, wherein said shape memory alloy has an $M_s$ temperature between about 30° C. and −96° C.

2. A shape memory alloy as claimed in claim 1, comprising nickel, titanium, and niobium within an area defined on a nickel, titanium, and niobium pseudo-binary phase diagram by a quadrilateral with its first vertex at 47.24 atomic percent titanium, 48.26 atomic percent nickel, and 4.5 atomic percent niobium; its second vertex at 41.32 atomic percent titanium, 38.68 atomic percent nickel, and 20 atomic percent niobium; its third vertex at 38 atomic percent titanium, 42 atomic percent nickel, and 20 atomic percent niobium; and its fourth vertex at 44.64 atomic percent titanium, 50.86 atomic percent nickel, and 4.5 atomic percent niobium, wherein said shape memory alloy has an $M_s$ temperature between about 30° C. and −196° C.

3. A shape memory alloy as claimed in claim 1, comprising nickel, titanium, and niobium within an area defined on a nickel, titanium, and niobium pseudo-binary phrase diagram by a quadrilateral with its first vertex at 47.24 atomic percent titanium, 48.26 atomic percent nickel, and 4.5 atomic percent niobium; its second vertex at 41.32 atomic percent titanium, 38.68 atomic percent nickel, and 20 atomic percent niobium; its third vertex at 39 atomic percent titanium, 41 atomic percent nickel, and 20 atomic percent niobium; and its fourth vertex at 45.5 atomic percent titanium, 50 atomic percent nickel, and 4.5 atomic percent niobium, wherein said shape memory alloy has an $M_s$ temperature between about 30° C. and −196° C.

4. A shape memory alloy as claimed in claim 1, comprising nickel, titanium, niobium within an area defined on a nickel, titanium, and niobium pseudo-binary phase diagram by a quadrilateral with its first vertex at 47.24 atomic percent titanium, 48.26 atomic percent nickel, and 4.5 atomic percent niobium; its second vertex at 37.5 atomic percent titanium, 32.5 atomic percent nickel, and 30 atomic percent niobium; it third vertex at 33.7 atomic percent titanium, 36.3 atomic percent nickel, and 30 atomic percent niobium; and its fourth vertex at 44.64 atomic percent titanium, 50.86 atomic percent nickel, and 4.5 atomic percent niobium, wherein said shape memory alloy has an $M_s$ temperature between about 30° C. and −196° C.

5. A shape memory alloy as claimed in claim 1, which consists essentially of nickel, titanium and niobium.

6. A shape memory alloy as claimed in claim 4, which consists essentially of nickel, titanium and niobium.

7. A shape memory alloy as claimed in claim 2, which consists essentially of nickel, titanium and niobium.

8. A shape memory alloy as claimed in claim 3, which consists essentially of nickel, titanium and niobium.

9. A shape memory article comprising a shape memory alloy, which has been thermo-mechanically treated to exhibit shape memory properties, comprising nickel, titanium, and niobium within an area defined on a nickel, titanium, and niobium pseudo-binary phase diagram by a quadrilateral with its first vertex at 48 atomic percent titanium, 49.5 atomic percent nickel, and 2.5 atomic percent niobium; its second vertex at 37.5 atomic percent titanium, 32.5 atomic percent nickel, and 30 atomic percent niobium; its third vertex at 33.7 atomic percent titanium, 36.3 atomic percent nickel, and 30 atomic percent niobium; and its fourth vertex at 45.5 atomic percent titanium, 52 atomic percent nickel, and 2.5 atomic percent niobium, wherein said shape memory alloy has an $M_s$ temperature between about 30° C. and −196° C.

10. A shape memory article as claimed in claim 9, comprising a shape memory alloy comprising nickel, titanium, and niobium within an area defined on a nickel, titanium and niobium pseudo-binary phase diagram by a quadrilateral with its first vertex at 47.24 atomic percent titanium, 48.26 atomic percent nickel, and 4.5 atomic percent niobium; its second vertex at 37.5 atomic percent titanium, 32.5 atomic percent nickel, and 30 atomic percent niobium; it third vertex at 33.7 atomic percent titanium, 36.3 atomic percent nickel, and 30 atomic percent niobium; and its fourth vertex at 44.64 atomic percent titanium, 50.86 atomic percent nickel, and 4.5 atomic percent niobium, wherein said shape memory alloy has an $M_s$ temperature between about 30° C. and −196° C.

11. A shape memory article as claimed in claim 9, comprising a shape memory alloy comprising nickel, titanium, and niobium within an area defined on a nickel, titanium, and niobium pseudo-binary phase diagram by a quadrilateral with its first vertex at 47.24 atomic percent titanium, 48.26 atomic percent nickel, and 4.5 atomic percent niobium; its second vertex at 41.32 atomic percent titanium, 38.68 atomic percent nickel, and 20 atomic percent niobium; its third vertex at 38 atomic percent titanium, 42 atomic percent nickel, and 20 atomic percent niobium; and its fourth vertex at 44.64 atomic percent titanium, 50.86 atomic percent nickel, and 4.5 atomic percent niobium, wherien said shape memory alloy has an $M_s$ temperature between about 30° C. and −196° C.

12. A shape memory article as claimed in claim 9, comprising a shape memory alloy nickel, titanium, and niobium within an area defined on a nickel, titanium, and niobium pseudo-binary phase diagram by a quadrilateral with its first vertex at 47.24 atomic percent titanium, 48.26 atomic percent nickel, and 4.5 atomic percent niobium; its second vertex at 41.32 atomic percent titanium, 38.68 atomic percent nickel, and 20 atomic percent niobium; its third vertex at 39 atomic percent titanium, 41 atomic percent nickel, and 20 atomic percent niobium; and its fourth vertex at 45.5 atomic percent titanium, 50 atomic percent nickel, and 4.5 atomic percent niobium, wherein said shape memory alloy has an $M_s$ temperature between about 30° C. and −196° C.

13. An article as claimed in claim 9, which is a coupling.

* * * * *

UNITED STATES PATENT AND TRADEMARK OFFICE

CERTIFICATE OF CORRECTION

PATENT NO. : 4,770,725
DATED : September 13, 1988
INVENTOR(S) : Simpson, et. al.

It is certified that error appears in the above-indentified patent and that said Letters Patent is hereby corrected as shown below:

Column 3, line 12, replace "now U.S. Pat. No. 541,844" bu --now U.S. Pat. No. 4,505,767--.

Column 13, Claim 1, line 50, replace "-96°C." by -- -196°C. --.

Column 14, Claim 4, line 12, after "titanium," insert --and--.

Column 15, Claim 11, line 13, replace "wherien" by --wherein--.

Signed and Sealed this

Twenty-second Day of February, 1994

*Attest:*

Bruce Lehman

BRUCE LEHMAN

*Attesting Officer*

*Commissioner of Patents and Trademarks*